United States Patent [19]

Ankarswed

[11] 4,291,513

[45] Sep. 29, 1981

[54] WALL CONSTRUCTION UNIT FOR BUILDINGS

[75] Inventor: Sven J. Ankarswed, Vesteras, Sweden

[73] Assignee: Ankarswedshus AB Vasteras, Sweden

[21] Appl. No.: 112,264

[22] Filed: Jan. 15, 1980

[30] Foreign Application Priority Data

Jan. 22, 1979 [SE] Sweden ..... 7900560

[51] Int. Cl.[3] ..... E04B 1/04; E04B 2/00

[52] U.S. Cl. ..... 52/284; 52/405

[58] Field of Search ..... 52/284, 286, 275, 279, 52/405

[56] References Cited

U.S. PATENT DOCUMENTS

| | | | |
|---|---|---|---|
| 2,208,589 | 7/1940 | Leemhuis | 52/279 X |
| 3,415,023 | 12/1968 | Lebreton | 52/405 |
| 4,164,831 | 8/1979 | Messick et al. | 52/405 |

FOREIGN PATENT DOCUMENTS

| | | | |
|---|---|---|---|
| 1609716 | 4/1970 | Fed. Rep. of Germany . | |
| 2337571 | 2/1975 | Fed. Rep. of Germany | 52/284 |
| 2411381 | 9/1975 | Fed. Rep. of Germany . | |
| 2728911 | 2/1978 | Fed. Rep. of Germany . | |
| 38451 | of 1955 | Poland | 52/284 |
| 210015 | 12/1966 | Sweden . | |
| 368846 | 7/1974 | Sweden . | |

*Primary Examiner*—J. Karl Bell

*Attorney, Agent, or Firm*—Karl W. Flocks

[57] ABSTRACT

A wall construction unit for buildings, said unit comprising a reinforced concrete layer with parallel, projecting flanges between which insulations are provided, and joists and an intermediate insulation preventing cold bridges are positioned on the free edge of the flanges by means of clamp-irons cast into the concrete flanges.

At one longitudinal edge the wall construction unit also has a longitudinally extending projection which constitutes the external corner of a building and is cast integrally with the rest of the wall construction unit, said projection being provided with an insulation and an intermediate insulation preventing cold bridges and situated beneath the joist positioned on its outer flange.

The wall construction unit is a pre-fabricated building component which is prepared to be ready for mounting by a casting process during which joists, intermediate insulation and other insulation are secured to the concrete by casting.

4 Claims, 5 Drawing Figures

WALL CONSTRUCTION UNIT FOR BUILDINGS

The present invention relates to a wall construction unit for buildings, said unit comprising a reinforced concrete layer constituting the outside of the building, from which layer longitudinal, substantially parallel, first, second and intermediate flanges of reinforced concrete, spaced apart at predetermined intervals, extend inwardly at right angles to the concrete layer, joists with intermediate insulation being joined by casting by means of clamp-irons to the free edge of said flanges, insulation material being provided in the space defined by two adjacent flanges with associated joists and intermediate insulation and by the inner side of the concrete layer.

It is previously known to prefabricate wall units to facilitate the erection of buildings. However, these prefabricated units merely concern the wall itself and therefore corner units must be applied and mounted to complete such known wall units. Manufacturing these corner units separately takes a lot of time and is expensive both with respect to production and mounting.

An object of the present invention therefore is to make a wall construction unit in which the wall unit is an integral part of the wall construction unit.

Another object of the present invention is to make a wall construction unit which is easy to manufacture and which complies with any standards established for the construction of buildings.

These objects are achieved by the invention in that the wall construction unit also includes a prolonged portion of the reinforced concrete layer extending from the second flange, and intermediate portion which extends from the end of the prolonged portion at right angles thereto and which is parallel with said flanges, and a terminating flange, with associated joist and intermediate insulation, which extends at right angles from the end of the intermediate portion in inward direction, the side of the terminating flange facing the prolonged portion being aligned with the outside of the insulation material, and insulation being provided in the space of substantially square cross-section which is defined by the second flange, the prolonged portion, the intermediate portion and the terminating flange.

Preferred embodiments of the present invention will become apparent from the following specification and the appended claims.

The invention will be described more fully hereinbelow with reference to the accompanying drawings which illustrate perferred embodiments and in which.

Figure 1:
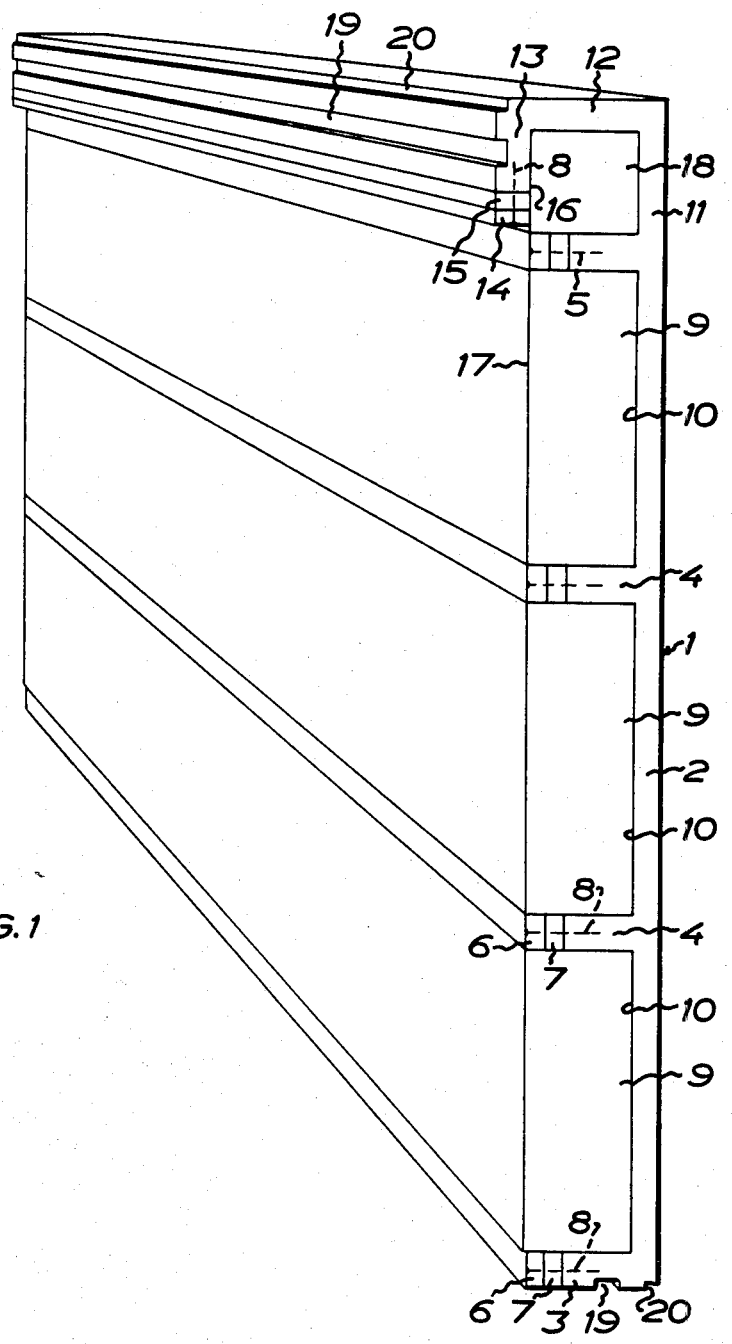
FIG. 1 is a perspective view of a wall construction unit according to the present invention.

Referring now to the drawings, FIG. 1 shows a wall construction unit according to the present invention for buildings. The unit 1 includes a reinforced concrete layer 2 which constitutes the outside of the building and from which longitudinal, substantially parallel, first, second and intermediate flanges, 3, 5 and 4, respectively, of reinforced concrete, spaced apart at predetermined intervals, extend at right angles to the concrete layer 2 towards the interior of the building. Joists 6 with intermediate insulation 7 preventing formation of cold bridges are joined by casting to the free edge of the flanges 3, 4 and 5 by means of clamp-irons 8 which are spaced apart at substantially constant intervals. Parallelepiped-shaped bodies 9 of insulation material are placed in the space defined by two adjacent flanges 3, 4 or 5 with associated joists 6 and intermediate insulation 7 and by the inner-side 10 of the concrete layer 2.

The wall construction unit 1 also comprises a prolonged portion 11 of the reinforced concrete layer 2 extending from the second flange 5, an intermediate portion 12 which is parallel with said flanges 3, 4 and 5 extends from the end of the prolonged portion 11 at right angles thereto, and a terminating flange 13, with associated joist and intermediate insulation 15, which extends at right angles from the end of the intermediate portion 12 in inward direction.

The side 16 of the terminating flange 13 facing the prolonged portion 11 is aligned with the outside 17 of the bodies 9 of insulation material.

A body 18 of insulation material is placed in the space of substantially square cross-section, which is defined by the second flange 5, the prolonged portion 11, the intermediate portion 12 and the terminating flange 13.

Figure 2:
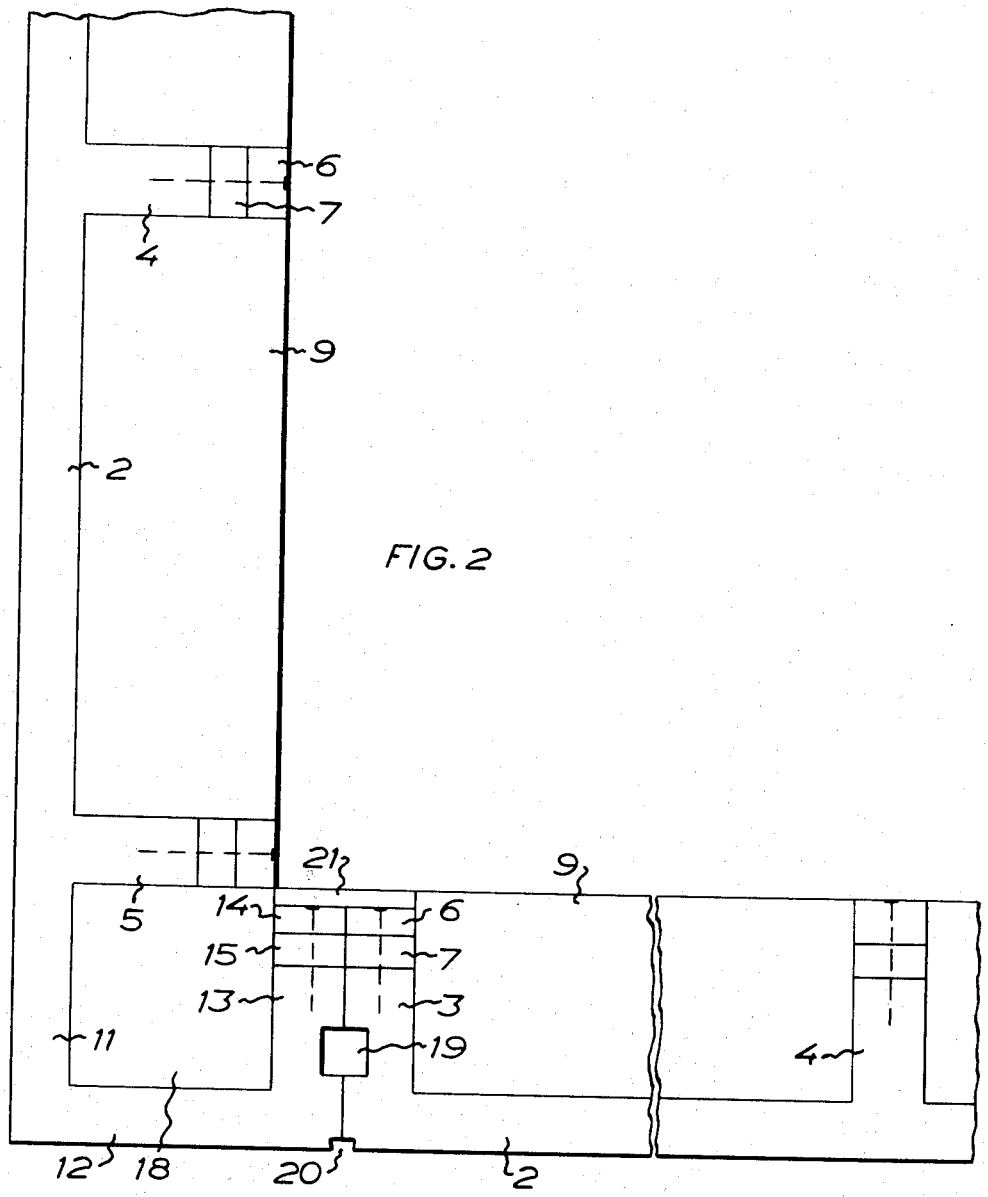
FIG. 2 is a fragmentary plan view of the external corner of a building, illustrating the mounting of a wall construction unit according to the invention.
Figure 3:
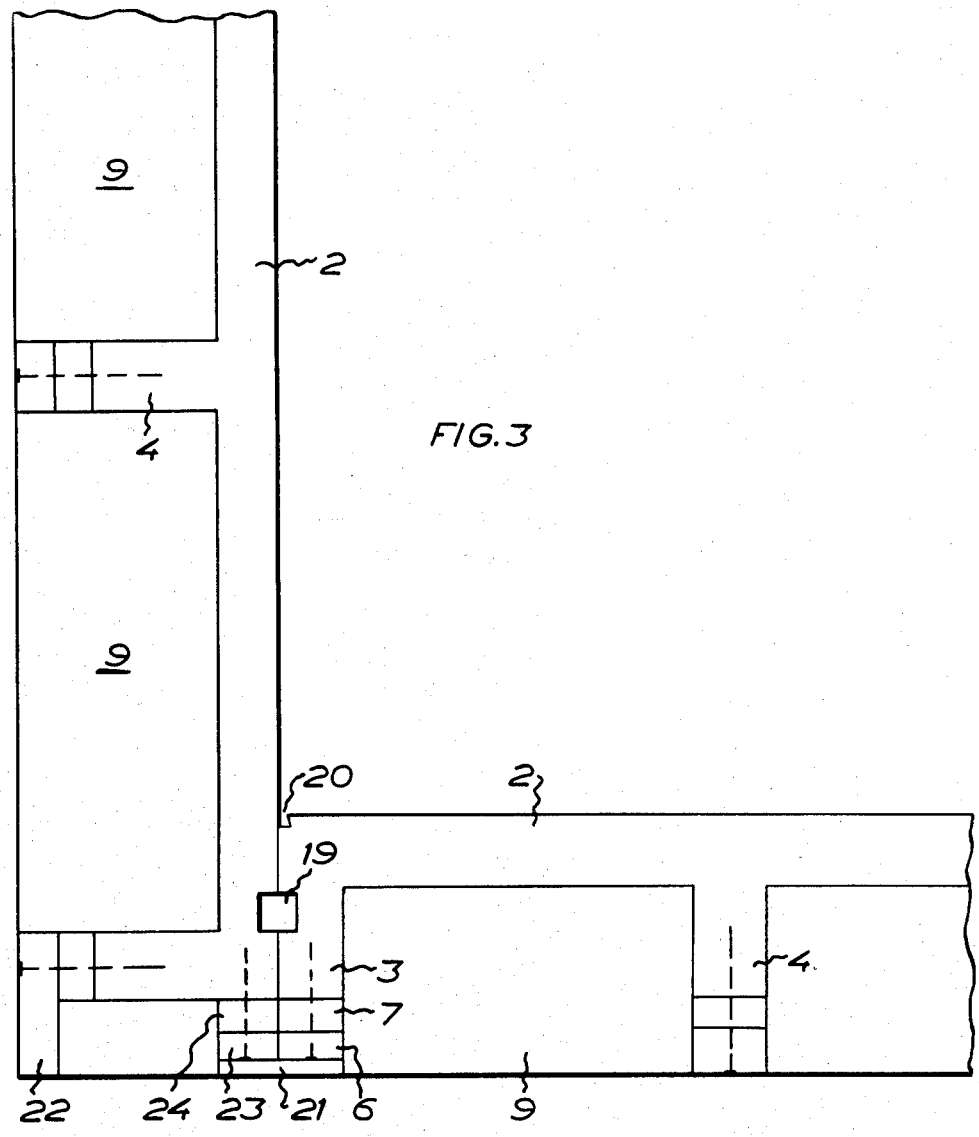
FIG. 3 is a fragmentary plan view of the internal corner of a building, illustrating the mounting of a wall construction unit according to the present invention.
Figure 4:
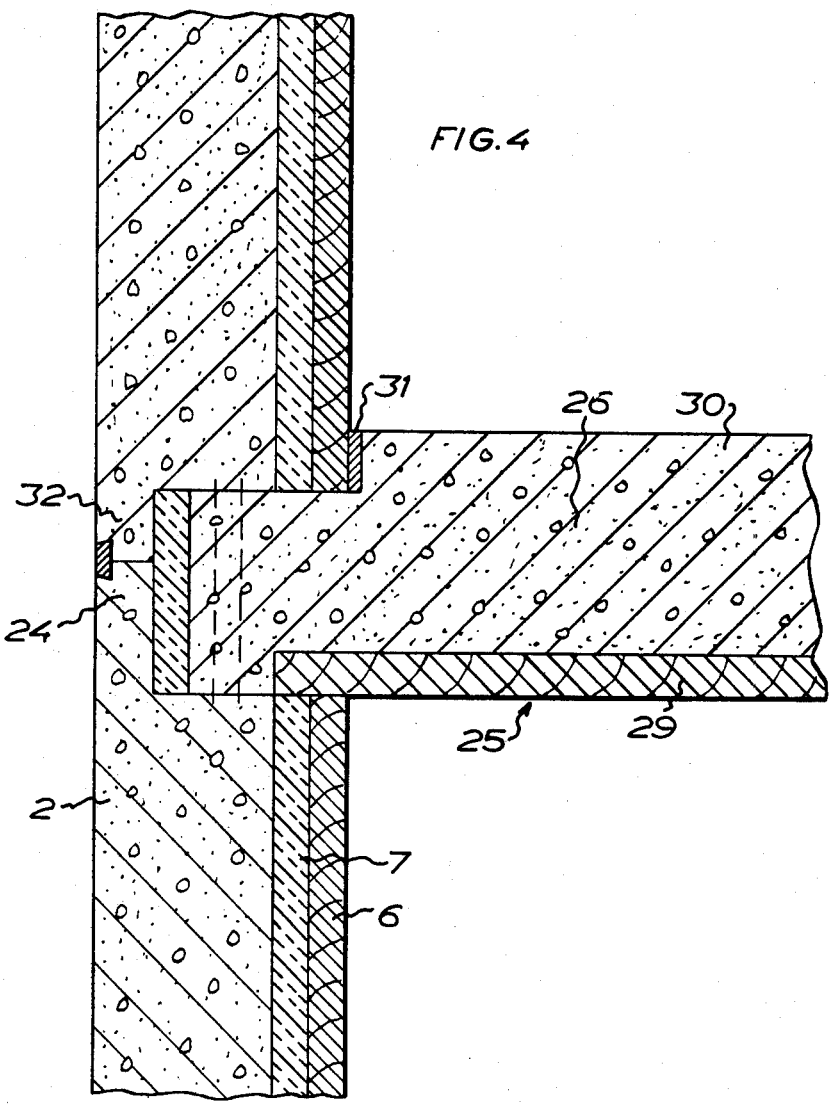
FIG. 4 is a fragmentary vertical section through a precast floor slab in an external wall, illustrating the mounting of a wall construction unit according to the invention for multi-storey buildings.
Figure 5:
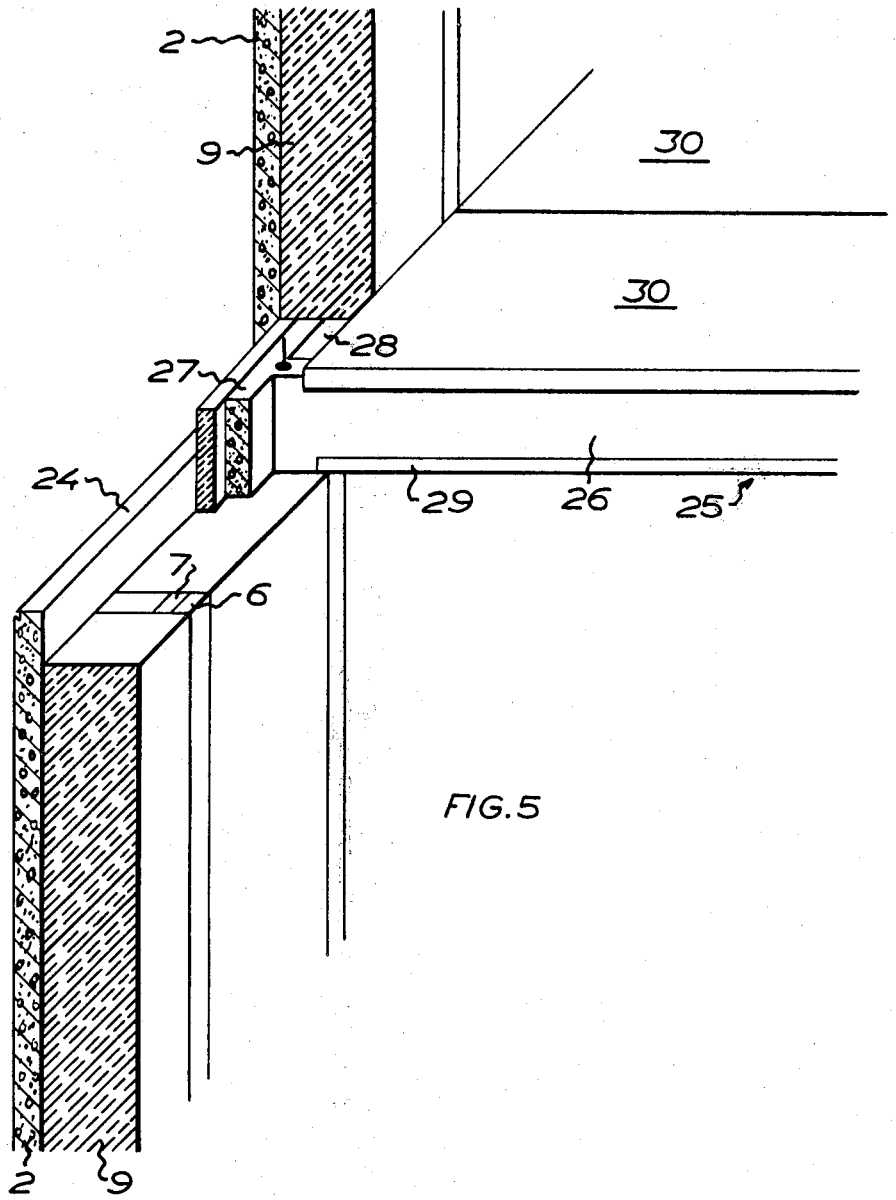
FIG. 5 is a fragmentary, partly sectional perspective view of the floor slab of FIG. 4.

The outer flanges of the wall construction unit 1, i.e. the first flange 3 and the terminating flange 13, have on the outside longitudinally extending recesses 19 which are adapted to be positioned right opposite a corresponding recess in an adjacent unit (see FIGS. 2 and 3). After mounting of the units, these recesses are to be filled with a mass, e.g. concrete of fluid concistency, for fixation of the units.

These outer flanges, i.e. the first flange 3 and the terminating flange 13, also have longitudinally extending notches 20 arranged along the outer corner edge and likewise adapted to be applied right opposite a corresponding notch in an adjacent unit (see FIGS. 2 and 3). After mounting of the units these notches are to be filled with a jointing mastic.

As appears from FIGS. 1, 2 and 3, the joists 6, 14 on the first flange 3 and the terminating flange 14 are narrower than the joists on the other flanges, i.e. the intermediate flanges 4 and the second flange 5. Upon mounting, adjacent units form a narrow slot in which a motion-absorbing sheet 21, e.g. of plywood, is attached to the joists.

FIGS. 2 and 3 illustrate the wall construction unit in mounted condition. FIG. 2 shows an external corner of a building, which corner has been mounted by means of a wall construction unit according to the invention. FIG. 3 shows how it is possible to make an internal corner for e.g. an extension of a building by moving during the casting operation the recess 19 from the flange to the outer side of the concrete layer 2 and by adding extra insulations and a larger joist 22 on the external flange and an extra joist 23 with insulation 24 against the cold bridge. However, in this embodiment no notch is necessary for the jointing mastic since the corner will end within the wall during mounting. In the adjacent unit there is a notch which is filled externally with jointing mastic during mounting. It is understood that the joists 23 and 6 have the same thickness in order to form a slot for receiving a motion-absorbing sheet as described above.

In a further development of the present invention a portion 24 of the upper side of the concrete layer is formed so as to project some distance from the insulation material bodies 9 and the flanges 3, 4, 5 and 13. A precast floor slab 25 consists of two or more longitudinal struts 26 of concrete, which are joined at their ends into a unit by means of cross-struts 27 of concrete cast integrally with said longitudinal struts. Insulating bodies 28 are placed in the parallelepiped-shaped spaces formed between the longitudinal and transverse struts 26 and 27. During the mounting operation the precast floor slabs are positioned on the wall construction units of the invention in such a way that the ends of the longitudinal struts will be placed on the flanges of the wall construction unit. Joists 29 are cast into the underside of the struts, whereby continuously coherent joists are formed over wall and ceiling. To prevent the formation of cold bridges between the precast floor slabs and the external wall, insulation is inserted between the portion 24 and the transverse strut 27 of the floor slab. A sub-floor 30 is cast on the top side of the floor slab, but a narrow slot 31 is left for jointing mastic and for fitting the floor slabs on the wall construction units. A projecting portion 32 corresponding to the projecting portion 24 is formed on the upper wall construction unit for the mounting of the latter in connection with the construction of multi-storey buildings.

For the manufacture of wall construction units according to the invention the insulation bodies 9 are placed on a casting bed liner and the joists 6, with the intermediate insulation 7 and the retaining clamp-irons 8, are positioned between the insulation bodies with the joists directed downwardly. After that the sides and stop ends of the form for the upper and lower edges of the wall construction unit and stop ends for windows, doors and other through-passage openings are mounted. If a wall construction unit for a house corner is to be manufactured according to the invention, a recess for the terminating flange 13 must be made in the casting bed and spacing means must be arranged around the insulation body 18 to keep it in proper position during casting. Thereupon a welded mesh reinforcement is laid out where required, e.g. for the concrete layer 2, the flanges 3, 4, 5 and 13, and the intermediate portion 12 and the prolonged portion 11. The welded mesh reinforcements are also kept in position by spacing means. Finally the form is filled with concrete which, in a manner per se known, is scraped off and vibrated and is allowed to harden.

The making of the precast floor slabs 25 is carried out in essentially the same way. The insulation bodies 28 and the joists 29 are placed on a casting bed liner with stop ends for through-passage openings, if any. Welded mesh reinforcements are placed with the aid of spacing means in those spaces in the form which will constitute the transverse and longitudinal struts 27 and 26 and the sub-floor 30. The form is then filled with concrete in the same manner as in the manufacture of the wall construction units.

In this way it is possible to prefabricate walls and floor slabs in dimensions suitable for mounting and then to assemble them on the site in a simple and rapid manner.

The invention is of course not limited to the embodiments described above but may be modified within the scope of the appendant claims.

What I claim and desire to secure by Letters Patent is:

1. Wall construction unit for buildings, said unit (1) comprising a reinforced concrete layer (2) constituting the outside of the building, from which layer longitudinal, substantially parallel, first, second and intermediate flanges (3, 5 and 4, respectively) of reinforced concrete, spaced apart at predetermined intervals, extend inwardly at right angles to the concrete layer, joists (6) with intermediate insulation (7) being joined by casting by means of clamp-irons (8) to the free edge of said flanges, insulation material (9) being provided in the space defined by two adjacent flanges (3, 4, 5) with associated joists (6) and intermediate insulation (7) and by the inner side (10) of the concrete layer (2), wherein the wall construction unit also includes a prolonged portion (11) of the reinforced concrete layer (2) extending from the second flange (5), an intermediate portion (12) which extends from the end of the prolonged portion at right angles thereto and which is parallel with said flanges (3, 4, 5), and a terminating flange (13), with associated joist (14) and intermediate insulation (15), which extends at right angles from the end of the intermediate portion in inward direction, the side (16) of the terminating flange facing the prolonged portion being aligned with the outside (17) of the insulation material (9), and insulation (18) being provided in the space of substantially square cross-section which is defined by the second flange (5), the prolonged portion (11), the intermediate portion (12) and the terminating flange (13).

2. A unit as claimed in claim 1, wherein the first flange (3) and the terminating flange (13) have arranged on the outside longitudinally extending recesses (19) for a mastic for fixation of adjacent units.

3. A unit as claimed in claim 1 or 2, wherein the first flange (3) and the terminating flange (13) have arranged along the outer corner edge longitudinally extending notches (20) for jointing mastic.

4. A unit as set forth in claim 1, wherein the joists (6, 14) on the first flange (3) and on the terminating flange (13) are narrower than the joists (6) on the intermediate flanges (4) and the second flange (5) to permit accommodation of a sheet (21) absorbing motion between adjacent units.

* * * * *